United States Patent [19]

Kaufmann

[11] Patent Number: 4,615,833

[45] Date of Patent: Oct. 7, 1986

[54] METHOD FOR VITRIFYING RADIOACTIVE WASTE SOLUTIONS

[75] Inventor: Friedrich Kaufmann, Hanover, Fed. Rep. of Germany

[73] Assignee: Deutsche Gesellschaft für Wiederaufarbeitung von Kernbrennstoffen mbH, Hanover, Fed. Rep. of Germany

[21] Appl. No.: 708,268

[22] Filed: Mar. 5, 1985

Related U.S. Application Data

[62] Division of Ser. No. 474,527, Mar. 11, 1983, Pat. No. 4,592,898.

[30] Foreign Application Priority Data

Mar. 13, 1982 [DE] Fed. Rep. of Germany ..... 3209250

[51] Int. Cl.[4] ..... G21F 9/16; G21F 9/20

[52] U.S. Cl. ..... 252/629; 34/122; 34/137; 34/210; 34/218; 34/226; 34/228; 210/682; 252/631; 422/159

[58] Field of Search ..... 252/629, 626, 627, 631, 252/632; 422/159; 210/681, 682; 110/237, 238; 134/108; 34/122, 131–132, 137, 210, 212, 215, 218, 219, 226, 228

[56] References Cited

U.S. PATENT DOCUMENTS

| | | | |
|---|---|---|---|
| 4,145,396 | 3/1979 | Grantham | 252/626 |
| 4,209,399 | 6/1980 | Lahr et al. | 252/631 |
| 4,416,855 | 11/1983 | Abrams et al. | 422/111 |

FOREIGN PATENT DOCUMENTS 2240928 3/1974 Fed. Rep. of Germany .

*Primary Examiner*—Stephen J. Lechert, Jr.
*Assistant Examiner*—Howard J. Locker
*Attorney, Agent, or Firm*—Walter Ottesen

[57] ABSTRACT

The invention is directed to a method vitrifying radioactive fission products in liquid solution. The liquid solution is pumped in metered quantities from a feed container to a vitrifying oven. The offgas occurring during vitrification is scrubbed of entrained radioactive dust particles and the like by a scrubbing liquid in a scrubber. In order to obtain a simplified sequence of method steps for metering the liquid solution and for scrubbing the offgas, the radioactive fission product solution from the feed container itself is used as the scrubbing liquid. This fission product solution is taken from the feed container and conducted to the counterflow scrubber through which it is passed in a direction opposite to the flow of the offgas. The fission product solution used as a scrubbing liquid is returned to the feed container after passing through the counterflow scrubber.

2 Claims, 1 Drawing Figure

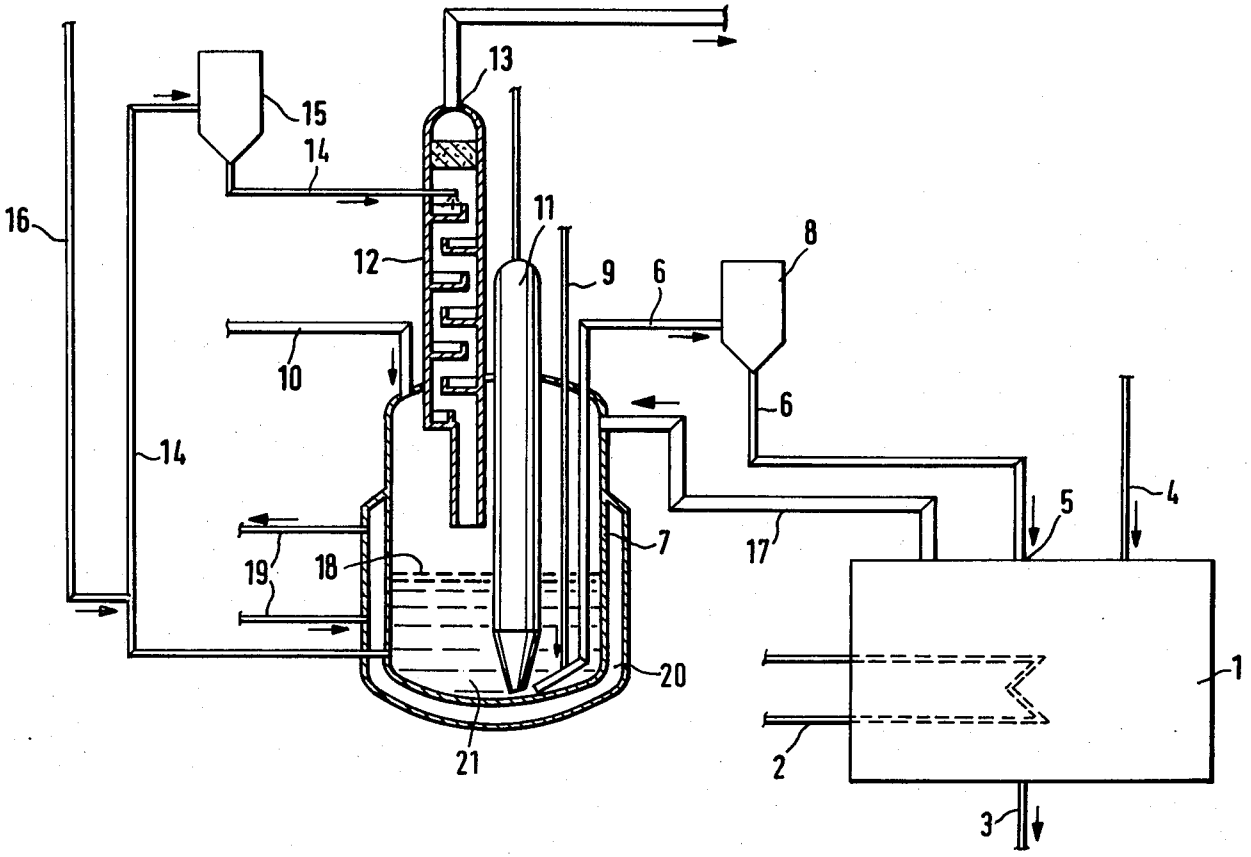
1
2
3
4
5
6
6
7
8
9
10
11
12
13
14
14
15
16
17
18
19
20
21

METHOD FOR VITRIFYING RADIOACTIVE WASTE SOLUTIONS

This is a division of application ser. No. 474,527, filed Mar. 11, 1983 which has been allowed and for which the issue fee has been paid (now U.S. Pat. No. 4,592,898).

FIELD OF THE INVENTION

The invention relates to a method and apparatus for simplifying and reducing the effort required to vitrify radioactive fission products present in liquid solution.

BACKGROUND OF THE INVENTION

Those radioactive fission products occurring in liquid form in the first extraction cycle of a reprocessing facility are usually fixed in glass since glass constitutes a mechanically stable product and the radionuclides are held tightly together thereby.

The glass fixing or vitrifying facility is fed with the highly radioactive fission-product solution in the conventional manner from a feed container in measured quantities. The feed container is charged from a ready receiver container for radioactive fission-product solutions which are to be processed.

Offgases occur during the vitrification of fission-product solutions in the melting oven of the glass-fixing or vitrifying facility. These offgases have to be freed from entrained radioactive dust particles and the like since the conduits and components would otherwise become blocked. It is therefore the conventional practice to pass the offgas through an offgas scrubbing stage for separating the dust particles therefrom. The offgas is scrubbed in this scrubbing stage in a counterflow of scrubbing liquid in which separated acids, dust particles and aerosols accumulate. Such an offgas scrubbing stage is shown in FIG. 3 of German patent 2,125,915 wherein the scrubbing column is designated by reference numeral 14. A pump 19 regulates the flow of liquid through the scrubbing column 14.

The scrubbing liquid is conducted in a circulatory system in order to minimize the occurrence of radioactive secondary waste. After a predetermined time, the scrubbing liquid becomes heavily contaminated and must be exchanged.

SUMMARY OF THE INVENTION

In view of the foregoing, it is an object of the invention to provide a method for vitrifying fission-product solutions wherein a simplified sequence of method steps and a reduced cost and effort for the scrubbing of the offgas is provided.

The method of the invention for vitrifying radioactive fission products in liquid solution is conducted in an apparatus including a vitrifying oven to which the liquid solution is metered from a feed container, and an offgas scrubber wherein the offgas occurring during vitrification is scrubbed of entrained radioactive dust particles and the like by a scrubbing liquid. The method of the invention includes the steps of: moving at least a portion of the liquid solution from the feed container to the head of the scrubber; passing the offgas through the scrubber in counterflow to said portion of the liquid solution; and returning said portion of the liquid solution to the feed container after passing the same through the gas scrubber.

Thus, it is a feature of the method of the invention to use the liquid fission-product solution disposed in the feed container itself as the scrubbing liquid. A separate scrubbing liquid which would constitute additional secondary waste is no longer required. The two method steps of discharging a measured flow of the fission-product solution from the feed container and the scrubbing of the offgas are substantially simplified with the method of the invention.

In a further embodiment of the invention, the method can include the steps of: first passing the offgas into the feed container above the liquid solution contained therein whereby the larger radioactive dust particles entrained therein can drop out of the offgas directly into the liquid solution; and then passing the offgas into the offgas scrubber.

Thus, it is advantageous to supply the offgas from the vitrification facility to the feed container above the surface level of the liquid contained therein. From this location, the offgas can reach the offgas scrubber. This provides the advantage that the offgas is subjected to a precleaning step already in the feed container before it enters into the offgas scrubber because the larger dust particles drop out of the offgas into the liquid solution.

An apparatus for conducting the method of the invention is also disclosed.

The apparatus for vitrifying highly radioactive fission product present in liquid solution includes: a vitrifying oven and a feed container for holding said liquid solution. First pump means moves metered quantities of the liquid solution from the feed container to the vitrifying oven wherein the fission product contained in the liquid solution is fixed in glass and offgas is generated, the offgas having radioactive dust particles and the like entrained therein. A counterflow scrubber communicates with the oven for receiving the offgas therefrom. Second pump means pumps at least a portion of the liquid solution from the container to the scrubber so as to cause said portion to flow through the scrubber in a direction opposite to the flow of the offgas thereby scrubbing the radioactive dust particles and the like therefrom and transferring the same to said portion of said liquid solution. The scrubber has a drain communicating with the feed container whereby said portion of the liquid solution laden with the radioactive dust particles and the like flows back into the feed container. The scrubbing liquid is thus conducted in a circulatory system and it is the liquid fission-product solution in the feed container that is used as the scrubbing liquid.

As mentioned above, it is a feature of the apparatus of the invention that the drain of the counterflow scrubber communicates with the feed container. Also, a conduit equipped with a metering pumping device is arranged between the feed container and the head of the counterflow scrubber. These features reduce the number of components the apparatus requires and simplify the assembly and maintenance thereof. The metering pumping devices can be of the type shown in FIG. 16.21(2) on page 212 of "Chemie der Nuklearen Entsorgung," Part II, published by Verlag Karl Thiemig, 1978. In this connection, reference may also be had to FIG. 11.4 (a+b) on page 172 of Part III of the same text.

In this way, the offgas counterflow scrubber and the feed container for the fission-product solution are joined in an advantageous manner into one component. The apparatus according to the invention provides a simple configuration and simplifies the process to be performed therewith.

According to an advantageous embodiment of the apparatus of the invention, the offgas conduit conducting the oven offgas communicates with the feed container at an elevation above the level of the surface of the liquid therein. Because of construction and design considerations, feeding the offgas into the feed container is more advantageous than supplying the same directly to the offgas counterflow scrubber having a smaller cross-section. Also, the precleaning of the offgas described above is obtained with this configuration.

In a further advantageous embodiment of the invention, an air pulsating system is arranged in the feed container which extends into the fission-product solution. With the aid of this air pulsating system, sedimentation on the floor of the feed container is prevented.

BRIEF DESCRIPTION OF THE DRAWING

The drawing shows a schematic representation of the apparatus for conducting the method of the invention.

DESCRIPTION OF THE PREFERRED EMBODIMENTS OF THE INVENTION

A conventional vitrifying oven 1 can be brought up to melting temperature by means of a heating arrangement 2. A typical vitrifying oven is shown on page 284 of the above-mentioned text entitled "Chemie der Nuklearen Entsorgung," Part II. The conduit 3 represents the outlet port for the melted glasses containing the radioactive fission products. The vitrifying oven 1 is supplied with glass particles via a charging inlet represented by conduit 4. The highly radioactive fission-product solution is fed in measured quantities to the oven 1 through a feed inlet 5.

A feed conduit 6 connects the feed inlet 5 with a feed container 7. A metering air lift container 8 of an air lift pumping arrangement is arranged in the conduit 6. Air lift pumping arrangements of this type have shown themselves to be useful where metered quantities of radioactive fission-product solutions have to be pumped. In air lift pumping arrangements of this type, the pumping movement is achieved by admitting bubbles of air into the liquid column. The air for the embodiment shown in the drawing is supplied through an air conduit 9 and fed to the feed conduit 6 at the lower end thereof which is arranged at the lower region of the feed container 7.

The pumping of the fission-product solution by means of the air lift is safer than with a pump since the air lift contains no moving parts. In this way, a possible exchange of a pump is eliminated. Further, there occurs no secondary waste through a contaminated pump, and the possibility of radiation to personnel during an exchange of pumps is eliminated.

The fission-product solution is supplied from a receiving container (not shown) to the feed container 7 by means of pumps or by means of a further air-lift system via a feed conduit 10. In this feed container 7, the level of liquid is always maintained between two predetermined boundary values.

A pulsator pipe 11 projects into the feed container 7 into which the liquid is drawn to generate an underpressure. By generating an overpressure, the liquid is expelled from the pulsator pipe 11. By means of this air pulsating system, sedimentation in the feed container 7 is prevented.

The lower end of a scrubber column 12 projects into the feed container 7. The scrubber column 12 has an outlet conduit 13 at its head for directing away the scrubbed oven offgas. This scrubber column 12 is charged with a scrubbing liquid at the upper region thereof. The scrubbing liquid is supplied via a metering conduit 14 in which an air-lift container 15 is arranged and is taken from the supply of liquid 21 in the feed container 7. The air for this air-lift pumping arrangement is supplied via air conduit 16.

The vitrifying oven 1 includes an offgas conduit 17 which communicates with the feed container 7 above the surface 18 of the liquid.

The offgas from the vitrifying oven 1 is hot and enters the feed container 7 at a very high temperature. Accordingly, the feed container 7 is configured so that it can be cooled as required. For this purpose, the container 7 is provided with a cooling jacket 20 supplied with a coolant via cooling supply means represented schematically at reference numberal 19.

The method according to the invention will now be described with reference to the apparatus of the invention.

The fission-product solution to be vitrified is fed to the feed container 7 from a receiver vessel (not shown). The feeding of the solution in this manner is via feed conduit 10. The level 18 of the liquid in the feed container 7 is monitored so that it always lies between two boundary values.

The upper boundary value of level 18 must not be exceeded to prevent an overfill condition in the feed container 7. Accordingly, the flow of fission-product solution to container 7 via conduit 10 is controlled and must be turned off when the upper boundary value is reached. This flow is intermittent and in small quantities of about 30 liters per hour. The lower boundary value of the level 18 has to be maintained to provide the air lift pumping arrangements with an adequate immersion depth to effect a pumping action.

The feed conduit 6 dips into the supply of fission-product solution. The fission-product solution is fed to the vitrifying oven 1 in measured quantities via conduit 6 by means of the air-lift container 8 and the air supplied via conduit 9. At the same time, glass particles are supplied to the vitrifying oven 1 as indicated by arrow 4. After the glass particles are melted, the radioactive fission products are bound into the glass and are periodically withdrawn from the vitrifying oven 1.

The offgas which develops during the vitrification has radioactive dust particles and aerosols entrained therein.

These contaminants must be separated from the offgas as will now be explained. The offgas with the entrained contaminants enters the feed container 7 above the level 18 of the liquid via an offgas conduit 17. By bringing the offgas into the feed container, some of the heavier dust particles drop directly into the solution 21.

The offgas with radioactive dust particles still contained therein then passes through the scrubbing column 12 from below and upwardly in counterflow to the scrubbing liquid fed into the column 12 at it upper region. The scrubbing liquid is drawn from the supply 21 of fission-product solution in the feed container 7. During its flow through the scrubbing column 12, the largest part of the dust particles, aerosols and the radionuclides escaping vitrification is taken up by the fission-product solution which serves as a scrubbing liquid. The contaminated scrubbing liquid flows back or drains into the feed container 7 from the scrubber column 12. A portion of this contaminated liquid is again returned from the feed container 7 to the gas scrubber 12;

whereas, another portion thereof is fed via feed conduit 6 to the vitrifying oven 1.

The air lift pumping arrangement 14, 15, 16 pumps the scrubbing liquid into the scrubber column 12 from the container 7 in a volume adequate to provide an effective scrubbing of the offgas entering the feed container via conduit 17. The cycling of a portion of the fission-product solution 21 in the container 7 continues uninterrupted as long as required to provide a continuous scrubbing of the offgas from the vitrifying oven 1.

When the components scrubbed from the offgas by the continuous gas scrubbing process accumulate in the fission-product solution 21 in the feed container 7 to the point where the accumulation exceeds permissible values which can not be taken up by the glass melt, a portion of the scrubbing solution is withdrawn and subjected to a further processing. The level of liquid in the feed container 7 is again raised via the feed conduit 10.

It is understood that the foregoing description is that of the preferred embodiments of the invention and that various changes and modifications may be made thereto without departing from the spirit and scope of the invention as defined in the appended claims.

What is claimed is:

1. A method of vitrifying radioactive fission products in liquid solution in an apparatus including a vitrifying oven to which the liquid solution is metered from a feed container, and an offgas scrubber wherein the offgas occurring during vitrification is scrubbed of entrained radioactive dust particles and the like by a scrubbing liquid, the method comprising the steps of:

moving quantities of said liquid solution from said feed container to said vitrifying oven wherein the fission product contained in said liquid solution is fixed in glass and offgas is generated, the offgas having radioactive dust particles and the like entrained therein;

passing said offgas from said vitrifying oven into said feed container;

moving at least a portion of said liquid solution from the feed container to the head of the scrubber;

passing the offgas through the scrubber in counterflow to said portion of the liquid solution whereby the radioactive dust particles entrained in the offgas are scrubbed therefrom and transferred to said portion of the liquid solution so as to become entrained therein; and, returning said portion of the liquid solution and said dust particles entrained therein to the feed container after passing the same through the scrubber.

2. The method of claim 1 including the steps of:

first passing the offgas into the feed container above the liquid solution contained therein whereby the larger radioactive dust particles entrained therein can drop out of the offgas directly into said liquid solution; and, then passing the offgas from said container directly into said offgas scrubber.

* * * * *